US006723231B1

(12) United States Patent
Geus et al.

(10) Patent No.: US 6,723,231 B1
(45) Date of Patent: Apr. 20, 2004

(54) PROPENE RECOVERY

(75) Inventors: Eduard Rudolf Geus, Amsterdam (NL); John William Harris, Amsterdam (NL); Johan Jan Barend Pek, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/980,059

(22) PCT Filed: May 30, 2000

(86) PCT No.: PCT/EP00/04997

§ 371 (c)(1),
(2), (4) Date: Nov. 29, 2001

(87) PCT Pub. No.: WO00/75263

PCT Pub. Date: Dec. 14, 2000

(30) Foreign Application Priority Data

Jun. 3, 1999 (EP) ..... 99304349

(51) Int. Cl.[7] ..... C10G 7/02; C10G 7/00; B01D 3/14

(52) U.S. Cl. ..... 208/351; 208/347; 208/354; 208/355; 208/358

(58) Field of Search ..... 208/347, 351, 208/354, 355, 358; 585/318

(56) References Cited

U.S. PATENT DOCUMENTS

| | | | |
|---|---|---|---|
| 4,605,493 A | 8/1986 | Harandi | 208/341 |
| 5,452,581 A | 9/1995 | Dinh et al. | 62/24 |
| 5,634,354 A | 6/1997 | Howard et al. | 62/624 |

*Primary Examiner*—Glenn Caldarola
*Assistant Examiner*—Tam M. Nguyen

(57) ABSTRACT

Process to separate propene from gaseous fluid catalytic cracking products by performing the following steps: a) separating a feed mixture comprising the gaseous products, propene and other saturated and unsaturated hydrocarbons obtained in a fluid catalytic cracking process into a hydrocarbon-rich liquid fraction and a hydrogen containing gaseous fraction, b) separating the hydrogen containing gaseous fraction into a hydrogen-rich gaseous fraction and a hydrocarbon-rich gaseous fraction by means of a membrane separation, c) supplying the hydrocarbon-rich gaseous fraction obtained in step (b) to an absorber section and obtaining in said absorber section a lower boiling fraction rich in gaseous products having a boiling point of ethane or below and supplying the hydrocarbon-rich liquid fraction obtained in step (a) to a stripper section and obtaining in said stripper section a higher boiling fraction comprising propene and hydrocarbons having a boiling point higher than ethane.

7 Claims, 2 Drawing Sheets

Figure 1:
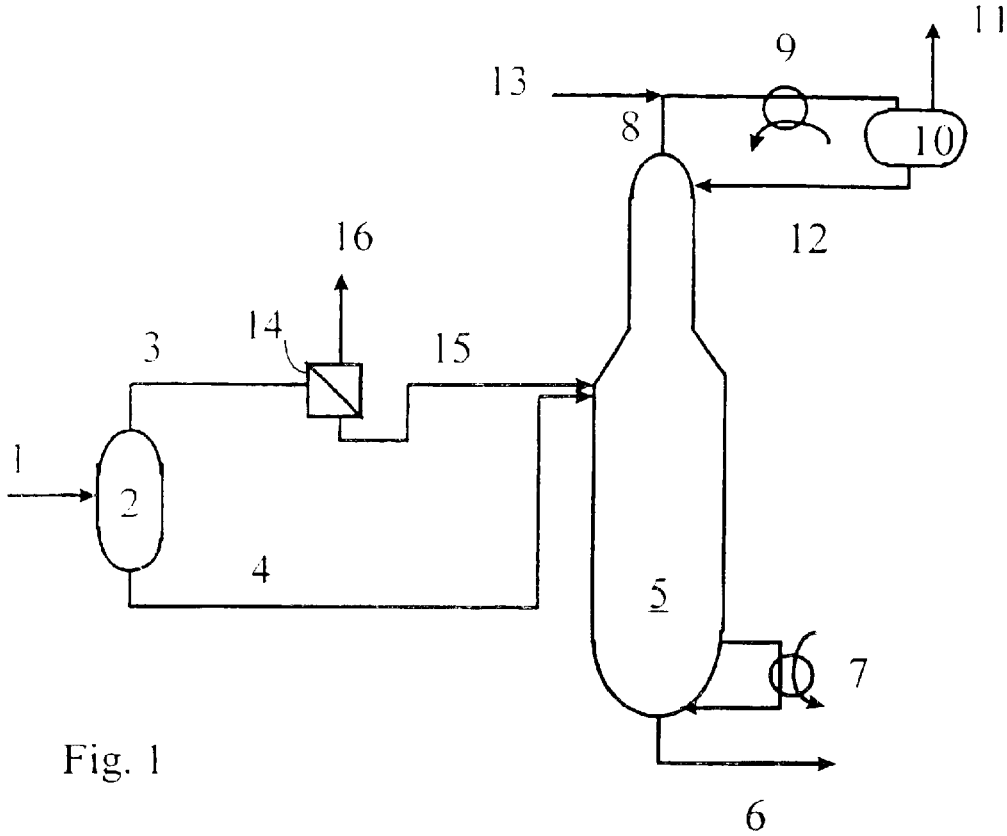

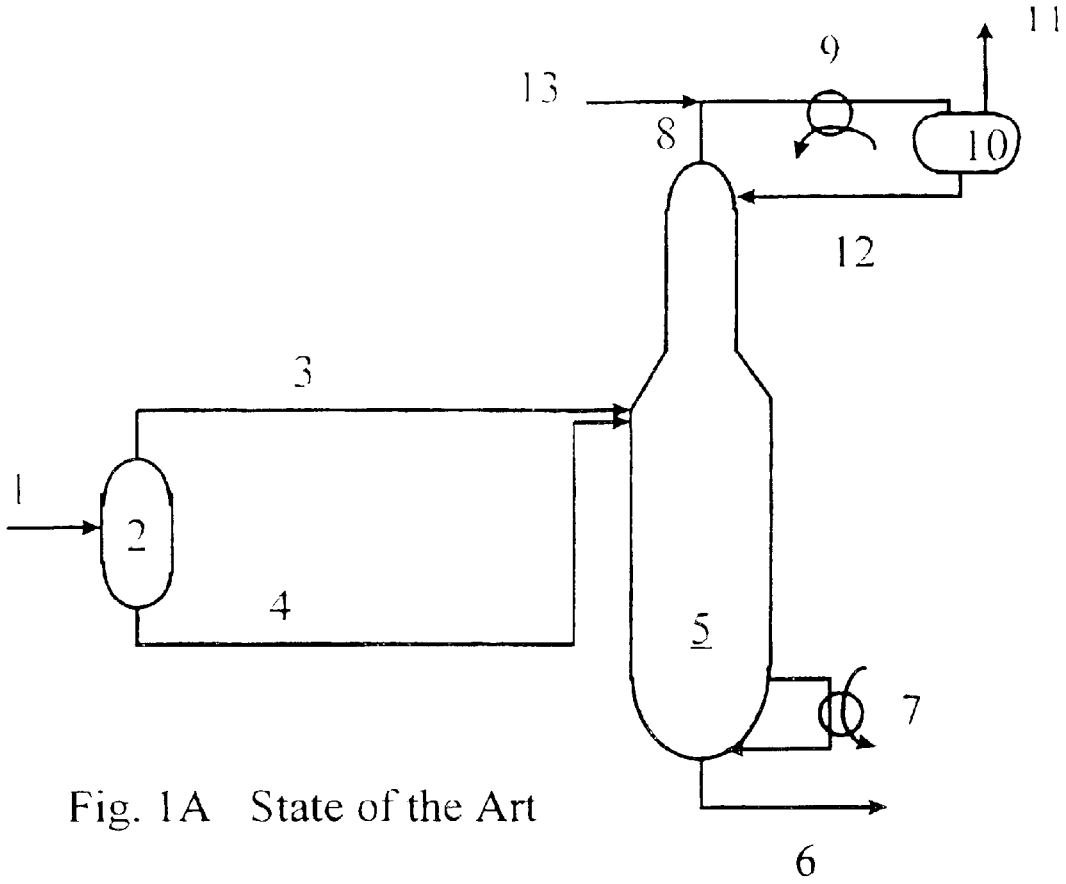
Fig. 1A State of the Art

PROPENE RECOVERY

The invention is directed to a process to separate propene from the product stream obtained in a fluidized catalytic cracking process.

In a fluid catalytic cracking (FCC) process a mixture of hydrocarbons is prepared by means of catalytic cracking of a petroleum distillate or residue fraction. The hydrocarbon reactor effluent is separated in a separation section into gasoline, light and heavy cycle oil and gaseous products, for example methane, LPG, propene and butene. In a conventional separation section the reactor effluent is first separated in a so-called main fractionator. The top product obtained in the main fractionator will comprise next to the so-called permanent gases like hydrogen, methane and nitrogen a certain amount of ethene, ethane, propene, propane and other saturated and unsaturated hydrocarbon compounds having a boiling point of below 220° C. The valuable hydrocarbon compounds boiling in the gasoline range are recovered from this top product in a so-called unsaturated gas plant as described in U.S. Pat. No. 4,605,493.

U.S. Pat. No. 4,605,493 describes a process in which the top product of the main fractionator is first compressed in one or more stages to a higher pressure level. This section is also referred to as the recontacting section. After the recontacting section the gaseous compounds having a boiling point of ethane and below are separated from the hydrocarbon products having a boiling point of at least propene and above by means of distillate separation step. This distillate separation step comprises in that the compressed top product is separated in a gaseous fraction and a liquid fraction by means of a flash operation. The gaseous traction is sent to an absorber section and the liquid product is sent to a stripping section. In the combined absorber and stripping section propene, propane and higher boiling hydrocarbon compounds are separated from the gaseous compounds including ethane and ethene and lower boiling compounds. In the embodiment illustrated in U.S. Pat. No. 4,605,493 the absorber and stripping sections are represented by two separate vessels. Embodiments in which both sections are present in one column are also known from the prior art.

Propene has become an important by-product of a FCC unit operation. The importance of this by-product is for example illustrated by the fact that dedicated ZSM-5 containing catalyst additives are used to enhance the propene yield in a FCC unit operation. A problem often associated with the increase in propene yield above the design value of an existing plant is that the above described rectifying absorber becomes a bottleneck. This bottleneck may for example result in that the part of the extra propene prepared in the FCC reactor will not be separated from the gaseous products in the rectifying absorber. Recovery of propene from the gaseous product downstream of the rectifying absorber is economically less attractive.

The object of the present invention is to provide a process in which propene can be separated from the gaseous FCC products with a higher efficiency than is possible with prior art processes.

This object is achieved by the following process: Process to separate propene from gaseous fluid catalytic cracking products by performing the following steps:

a) separating d feed mixture comprising the gaseous products, propene and other saturated and unsaturated hydrocarbons obtained in a fluid catalytic cracking process into a hydrocarbon-rich liquid fraction and a hydrogen containing gaseous fraction, b) separating the hydrogen containing gaseous fraction into a hydrogen-rich gaseous fraction and a hydrocarbon-rich gaseous fraction by means of a membrane separation, c) supplying the hydrocarbon-rich gaseous fraction obtained in step (b) to an absorber section and obtaining in said absorber section a lower boiling fraction rich in gaseous products having a boiling point of ethane or below and supplying the hydro-carbon-rich liquid fraction obtained in step (a) to a stripper section and obtaining in said stripper section a higher boiling fraction comprising propene and hydrocarbons having a boiling point higher than ethane.

Applicants have found that by separating of part of the hydrogen present in the feed to the rectifying absorber in step (c) that the efficiency of the propene recovery is improved. This improvement enables one, for example, to either make use of smaller distillate units for new FCC units or to de-bottleneck existing FCC units enabling a higher propene production. An additional advantage is that hydrogen is obtained having a reasonable good quality in a relatively simple manner when compared to methods which can recover hydrogen from gaseous fractions at a point more down stream of the rectifying absorber. A further advantage is that in step (b) part of the sour gasses like $H_2S$ and HCN are removed with the hydrogen, thereby reducing the amount of corrosive compounds in step (c).

The feed mixture of step (a) is a mixture obtained in a FCC main fractionator comprising gaseous products and saturated and unsaturated hydrocarbons ranging from methane to hydrocarbons having an atmospheric bolting point of about 253° C. and preferably to about 220° C. Apart from hydrogen the gaseous FCC products comprise various components like $NH_3$, $H_2S$, CO, $CO_2$, and $H_2O$. The feed mixture has a pressure typically between 11 and 25 bars. The content of hydrogen in the hydrogen containing gaseous fraction will suitably be 3 vol. % or higher. In a typical FCC process the hydrogen content in the hydrogen containing gaseous fraction will be between 5–20 vol. %.

The separation in a liquid and gaseous fraction in step (a) can be achieved by a conventional flash operation, for example in a knock out vessel. It has been found advantageous to reduce the contaminant level (especially $NH_3$ and $H_2S$) of the hydrogen containing gaseous fraction sent to step (b). This leads to a more hydrogen-rich gaseous fraction in step (b). Removal of sour gasses can be achieved by conventional methods. For example by contacting the feed prior to step (a) with water and separating in step (a) the feed mixture into a sour water fraction and the above mentioned hydrocarbon-rich liquid fraction and hydrogen containing gaseous fraction. Such a separation may be suitably performed in a three phase separation vessel.

Step (b) can be performed by making use of conventional membrane separation means, which are known to be selective of separating hydrogen from small hydrocarbons. Selective separation occurs when a pressure gradient across the membrane is applied. Preferably a hydrogen separation selectivity greater than 20, more preferably greater than 50, is required, wherein the selectivity is defined as the permeability ratio of hydrogen over methane. Permeability is defined as the number of moles of a compound which permeates a membrane per square meters per day per bar of pressure difference.

It is also advantageous for the propene recovery in step (c) when membranes are used through which methane and ethane will permeate significantly faster than the heavier hydrocarbons ($C_3$+). Preferably the membrane has a methane separation selectivity of greater than 5, wherein the selectivity is defined as the permeability ratio of methane over propane. Suitable membranes should further have a sufficient permeation rate for the hydrogen and should have a sufficient life time. Preferred membranes further show a good resistance to liquid hydrocarbons. The membranes can be made from either inorganic or organic material. Examples of inorganic materials are ceramic, carbon and molecular sieve materials. An example of a ceramic membrane is described in U.S. Pat. No. 5,827,569. Organic membrane materials are preferably of a polymer material, for example polyaramid, polyetherimide and polyimid. Examples of commercial membrane systems which can be used in the process according to the invention are Medal of L'Air Liquide, Prism alpha of Air Products, Polysep of UOP and Membrane Systems (e.g. module B-H) of Ube.

The membrane is suitably in the form of a hollow fibre placed in a membrane unit in a conventional manner known to one skilled in the art. In such a membrane unit a bundle of hollow membrane fibres are placed in a vessel in such a manner that hydrogen present in the feed to the unit can pass the membrane fibre from the shell side to the inside of the fibre resulting in a second gaseous fraction rich in hydrogen and a gaseous fraction enriched in hydrocarbons. The vessel has outlet conduits and spaces to collect the hydrogen rich gaseous fraction collected in the fibres and inlet means at the shell side for the gaseous fraction and outlet means for the hydrocarbon rich fraction. In a preferred embodiment a number of such vessels are arranged in series in order to achieve the desired separation and to avoid the use of large vessels.

The temperature in step (b) is preferably at least 20° C. higher than the dew point of the hydrogen containing gaseous mixture send to step (b) when membrane materials are used which are sensitive to liquid hydrocarbons. Additional means for heating this gaseous mixture should then be provided to heat the hydrogen containing mixture prior to step (b). Preferably the temperature in step (b) is between 50–100° C. and more preferably between 70–90° C.

The hydrogen containing gaseous fraction in step (b) suitably will have a pressure greater than 11 bar, preferably greater than 15 bar which enables an efficient separation in step (b). The pressure ratio of the pressure of the hydrogen containing gaseous mixture send to step (b) and the hydrogen-rich gaseous mixture obtained in step (b) is suitably greater than 2 and preferably greater than 5. Although the separation rate is negatively influenced when a low pressure ratio is used, it may in some cases be advantageous when the resulting higher pressure hydrogen-rich gaseous fraction is further purified. When the hydrogen-rich fraction is used as fuel higher pressure ratios may advantageously be applied. Preferably more than 50% of the hydrogen present in the hydrocarbon feed mixture is separated in step (b).

In step (c) the hydrocarbon-rich gaseous fraction obtained in step (b) is supplied to an absorber section. This absorber section may be a single column or a combination of more columns which comprise at least means to condense the gaseous top product, means to recycle the condensed top product to the absorber section and means to discharge a higher boiling liquid fraction to the stripper section. This liquid fraction may be advantageously send to step (a) in order to separate any gaseous compounds in this fraction before sending it to the stripper section. This latter embodiment is illustrated in U.S. Pat. No. 4,605,493.

The absorber section may further be suitably provided with means to supply a liquid hydrocarbon mixture, which mixture is poor in at least propene, to the top or discharge end of the absorber section. This hydrocarbon mixture, also referred to as lean oil, serves to absorb into the liquid phase as much propene and other valuable higher boiling hydrocarbons in the absorber section before being discharged to the stripper section. Examples of suitable sources of lean oil are the higher boiling fraction obtained in a debutanizer or the condensed fraction directly obtained from the top product of the main fractionator of a fluidized catalytic cracking process. In the condenser the lower boiling gaseous fraction rich in gaseous products having a boiling point of ethane or below is obtained.

In step (c) the hydrocarbon-rich liquid fraction obtained in step (a) is supplied to a stripper section. The stripper section is provided with reboiler means to evaporate any lower boiling compounds resulting in a gaseous fraction, means to discharge the higher boiling fraction comprising propene and hydrocarbons having a boiling point higher than ethane and means to discharge the gaseous fraction to the absorber section. This gaseous fraction may be send to step (a) before being supplied to the absorber section as illustrated in U.S. Pat. No. 4,605,493. However preferably the gaseous fraction obtained in the stripping section is send directly to the absorber section in order to achieve that the hydrogen concentration in the hydrogen containing gaseous fraction obtained in step (d) is as high as possible. A higher hydrogen concentration is favourable for the efficiency of the membrane separation in step (b).

The stripper section may be d single column or a combination of more columns. An example of an embodiment of step (c) is described in the afore mentioned U.S. Pat. No. 4,605,493. In a preferred embodiment absorber section and the stripping section are combined in one distillation column, optionally provided with one or more additional side-coolers and reboilers. Such a combined column is referred to as a so-called rectifying absorber.

It has been found that the propene recovery is even further improved when the hydrocarbon-rich liquid fraction obtained in step (a) is fed to a position in the rectifying absorber column above the feed inlet of the hydrocarbon rich gaseous fraction obtained in step (b). Preferably between 2–6 practical trays are present between these two inlets.

The operation conditions in the rectifying absorber may be those conventionally applied. The pressure at the top may typically range between 10 and 25 bars and the bottom temperature between 110 and 140° C.

The higher boiling fraction comprising propene and hydrocarbons having a boiling point higher than ethene obtained in step (c) can be further processed in a conventional manner in which propene is recovered by distillation from the other hydrocarbon products.

The invention shall be illustrated making use of FIG. 1A and FIG. 1. FIG. 1A represents a rectifying absorber column according to the state of the art. Via stream (1) a feed mixture comprising gaseous products, propene and other saturated and unsaturated hydrocarbons is supplied to a knock out vessel (2) resulting in a hydrocarbon-rich liquid fraction which is discharged via stream (4) to the rectifying absorber column (5) and a hydrogen containing gaseous traction which is discharged via stream (3) to the rectifying absorber column (5). The rectifying absorber column (5) is equipped with a gas outlet (8) for the gaseous top fraction, a condenser (9) and a condenser collection vessel (10) in which the gaseous components are separated via (11) from the condensed liquid fraction which liquid fraction is recycled via (12) to the top of the column. Via stream (13) lean oil is mixed with the gaseous top product up-stream of condenser (9). Most of the propene present in the gaseous fraction present in stream (8) will be absorbed by the lean oil and returned to the rectifying absorber via (12). The rectifying absorber is further equipped with a reboiler (7). Via stream (6) the liquid bottom fraction enriched in propene is discharged to downstream separation units.

FIG. 1 represents a process according to the invention. The meaning of the reference signs is the same as in FIG. 1A. In addition to the process represented in FIG. 1A a membrane separation unit (14) is shown in which a hydrogen-rich gaseous fraction is obtained and discharged via (16) and a hydrocarbon-rich gaseous fraction is obtained which is supplied to the rectifying absorber column (5) via (15).

The invention is especially directed to a method for retrofitting an existing separation unit which is part of the down stream separation means of a fluid catalytic cracking unit, and wherein in the separation unit the gaseous compounds having a boiling point of ethane and below are separated from the hydrocarbon products having a boiling point of at least propene. The existing separation unit, which has also been described above, comprises an absorber and stripping sections and separation flash means in which the hydrocarbon feed is first separated in a liquid and gaseous fraction. Preferably the absorber and stripping sections are combined in one rectifying absorber column. The retrofitting comprising adding means to remove hydrogen, preferably by means of membrane separation, from the gaseous fraction obtained in the flash separator. Preferably use is made of existing feed inlets in the respective absorber and stripping sections for the gaseous traction obtained in the membrane unit and the liquid fraction obtained in the flash separator.

The invention is also directed to the use of a membrane separator to remove hydrogen from a feed of a distillate separation unit which is used to separate gaseous compounds having a boiling point of ethane and below from hydrocarbon products having a boiling point of at least propene.

The invention will be illustrated by the following non-limiting examples which are calculations using a mathematical model describing the knock out vessel and the rectifying absorber. A conventional value for the membrane separation efficiency is used.

EXAMPLE 1

To a knock out vessel a typical FCC compressed top product of the main fractionator is sent having a pressure of 17.1 bar. Hydrogen was separated from the gaseous mixture as obtained in the knock out vessel in a membrane separation unit resulting in a gaseous mixture rich in hydrocarbons. The hydrogen rich gaseous fraction obtained has a pressure of 2 bars. The hydrocarbon-rich mixture is supplied to a typical rectifying absorber at the same feed inlet location as the feed inlet location of the liquid fraction obtained in the knock out vessel. The propene recovery is 95.1% calculated on the feed mixture. See also Table 1.

EXAMPLE 2

Example 1 as repeated except that the feed inlet of the gaseous mixture rich in hydrocarbons is 4 practical trays below the feed inlet of the liquid fraction obtained in the knock out vessel. The feed inlet position of the liquid fraction is the same as used in Example 1. The propene recovery is 96.1% calculated on the feed mixture. See also Table 1.

EXAMPLE 3

Example 1 is repeated except that the membrane area is half the area used in Example 1. The propene recovery is 93.3% calculated on the feed mixture. See also Table 1.

EXAMPLE 4

Example 1 is repeated except that the membrane area is 50% larger than the area used in Example 1. The propene recovery is 95.8% calculated on the feed mixture. See also Table 1.

COMPARATIVE EXPERIMENT A

Example 1 is repeated except that the mixture having the composition (I) is supplied directly to the rectifying absorber without making use the knock out vessel and the membrane unit. The location of the feed inlet is the same as in Example 1. The propene recovery is 89.2% calculated on the feed mixture.

TABLE 1

| Example → | 1 | 2 | 3 | 4 |
|---|---|---|---|---|
| membrane area ($M^2$) | 6000 | 6000 | 3000 | 9000 |
| Pressure of stream (11) (bar) | 16.3 | 16.3 | 16.3 | 16.3 |
| Fraction of $H_2$ removed (% on feed) | 76 | 76 | 56 | 84 |
| propene recovery (% on feed) | 95.1 | 96.1 | 92.3 | 95.8 |
| capacity increase compared to base case: Comparative experiment A | 6% | 11% | 5% | 9% |

What is claimed is:

1. Process to separate propene from gaseous fluid catalytic cracking products by performing the following steps:

a) separating a feed mixture comprising the gaseous products, propene and other saturated and unsaturated hydrocarbons ranging from methane to hydrocarbons having a boiling point of 250° C. as obtained in a fluid catalytic cracking process into a hydrocarbon-rich liquid fraction and a hydrogen containing gaseous fraction, b) separating, at a temperature between 50 and 100° C., the hydrogen containing gaseous fraction into a hydrogen-rich gaseous fraction and a hydrocarbon-rich gaseous fraction by membrane separation means defined by having a methane separation selectivity and a hydrogen separation selectivity, c) supplying the hydrocarbon-rich gaseous fraction obtained in step (b) to an absorber section, wherein to the top or discharge end of the absorber section a liquid hydrocarbon mixture is supplied to, which hydrocarbon mixture is poor in propene, and obtaining in said absorber section a lower boiling gaseous fraction rich in gaseous products having a boiling point of ethane or below, and d) supplying the hydrocarbon-rich liquid fraction obtained in step (a) to a stripper section and obtaining in said stripper section a gaseous fraction and a higher boiling fraction comprising propene and hydrocarbons having a boiling point higher than ethane.

2. The process of claim 1, wherein the gaseous fraction obtained in the stripping section is supplied directly to the absorber section.

3. The process of claim 1, wherein the higher boiling fraction is supplied to step (a).

4. The process of claim 1, wherein the stripping section and the absorber are combined in one distillation column.

5. The process of claim 4, wherein the hydrocarbon rich liquid fraction obtained in step (a) is fed to a position in the distillation column above the feed inlet of the hydrocarbon rich gaseous fraction obtained in step (b).

6. The process of claim 1, wherein the hydrogen separation selectivity of the membrane separation in step (b) is greater than 20, wherein the hydrogen separation selectivity is defined as the permeability ratio of hydrogen over methane.

7. The process of claim 1, wherein the methane separation selectivity of the separation in step (b) is greater than 5, wherein the methane separation selectivity is defined as the permeability ratio of methane over propane.

* * * * *